United States Patent [19]

Veltri

[11] Patent Number: 4,523,694

[45] Date of Patent: Jun. 18, 1985

[54] DISPENSING CAP

[76] Inventor: Douglas F. Veltri, 551 Washington St., Carlstadt, N.J. 07072

[21] Appl. No.: 562,187

[22] Filed: Dec. 16, 1983

[51] Int. Cl.[3] ..... B65G 59/00

[52] U.S. Cl. ..... 221/265; 221/288; 221/312 C

[58] Field of Search ..... 221/265, 264, 263, 288, 221/246, 262, 266; 220/253; 222/370, 452, 519, 359; 206/807, 540

[56] References Cited

U.S. PATENT DOCUMENTS

| | | | |
|---|---|---|---|
| 3,079,043 | 2/1963 | Le Blanc et al. | 221/265 |
| 3,102,662 | 9/1963 | Crabtree | 222/370 X |
| 3,224,634 | 12/1965 | Semsch | 222/452 X |
| 3,245,589 | 4/1966 | Temliak | 221/265 X |
| 3,991,908 | 11/1976 | Thomas et al. | 221/265 X |
| 4,273,254 | 6/1981 | Cuppleditch et al. | 221/265 X |

FOREIGN PATENT DOCUMENTS

| | | | |
|---|---|---|---|
| 662597 | 5/1963 | Canada | 221/21 |

*Primary Examiner*—Joseph J. Rolla
*Assistant Examiner*—David H. Bollinger
*Attorney, Agent, or Firm*—Harvey B. Jacobson

[57] ABSTRACT

A dispensing cap for medication containers and the like enabling a single dosage of such medication to be dispensed from the container in response to each cycle of movement of an external movable component forming a portion of the cap. The cap includes a stationary inner cap attached to the mouth or neck of the container, an outer cap rotatably connected to the inner cap and a rotor disposed between the inner and outer caps and geared thereto in a manner which will cause the rotor to rotate in a direction opposite to rotational movement of the outer cap. The inner cap, rotor and outer cap each have a discharge port therein which are movable between aligned and misaligned positions so that a single pill, capsule, dosage of medication or other item will be discharged by gravity from the dispensing cap for each cycle of operation thereof.

12 Claims, 10 Drawing Figures

DISPENSING CAP

BACKGROUND OF THE INVENTION

1. Field of the Invention

The present invention generally relates to devices for dispensing medication or the like and more particularly to a dispensing cap for a bottle or container having a plurality of pills, capsules or the like therein so that a single pill can be discharged by gravity from the container through the dispensing cap for each cycle of operation of the dispensing cap in which the dispensing cap includes an inner cap, rotor and outer cap each having a discharge port therein which move into various relative positions during each cycle of rotational movement of the outer cap in relation to the inner cap with the port in the rotor being in the form of a chamber capable of receiving one pill or capsule from the port in the inner cap and then moving out of alignment with the port in the inner cap for alignment with the discharge port in the outer cap so that only a single pill, capsule or the like will be discharged for each rotational cycle of movement of the outer cap.

2. Description of the Prior Art

Many efforts have been made to provide caps for medication containers such as pill bottles and the like to control access to the contents of the container and also enable effective discharge of a single pill or single dosage of medication. In some instances, such devices are rather difficult to manipulate which may be effective against undesired access by children but also is difficult for other individuals to manipulate. For example, elderly persons, handicapped persons and the like frequently find that such caps are difficult to operate especially when it is necessary to rapidly gain access to such medication. The following U.S. patents disclose known structures in this field of endeavor:

U.S. Pat. No. 3,245,598, Apr. 12, 1966
U.S. Pat. No. 3,991,908, Nov. 16, 1978
U.S. Pat. No. 4,273,254, June 16, 1981

SUMMARY OF THE INVENTION

An object of the present invention is to provide a dispensing cap for a bottle or other container for pills, capsules, other medication or other materials by which a single pill, capsule, dosage of medication or single item may be dispensed from the container by gravity during each cycle of operation of the dispensing cap.

Another object of the invention is to provide a dispensing cap in accordance with the preceding object which includes an inner cap stationarily mounted on the container, an outer cap rotatably connected with and mounted on the inner cap and a rotor between the inner cap and outer cap rotatable in relation to both the inner and outer cap with each component of the dispensing cap including a discharge port for movement between aligned and misaligned relationships to enable a single pill, dosage of medication or item to be discharged into a chamber or port in the rotor when it is aligned with the port in the inner cap after which the rotor and outer cap are rotated in a manner to misalign the port in the rotor with the port in the inner cap and align the port in the outer cap with the port in the rotor for discharging the pill, dosage of medication or item from the port in the rotor through the port in the outer cap.

A further object of the invention is to provide a dispensing cap in accordance with the preceding objects in which the components of the dispensing cap are interconnected by a gear assembly which will cause rotation of the rotor in a direction opposite to the direction of rotation of the outer cap with the angular displacement of the rotor being less than the angular displacement of the outer cap so that the port in the rotor will move to a position out of alignment with the port in the inner cap and block off the port in the inner cap as it becomes aligned with the port in the outer cap.

Still another object of the present invention is to provide a dispensing cap in which the inner cap includes a raceway or channel that inclines toward the discharge port for gravity movement of pills or the like along the raceway or channel to align a single pill, capsule, dosage or other item with the port in the inner cap so that it will discharge into the port or chamber in the rotor when these ports are aligned.

A still further object of the present invention is to provide a dispensing cap in accordance with the preceding objects in which all of the components may be readily constructed of plastic material thereby rendering the device relatively inexpensive to manufacture but yet effective for the purpose of dispensing a single pill, capsule, dosage or other item for each rotational cycle of movement of the outer cap with the dispensing cap being relatively inexpensive to manufacture and easily assembled onto a container and easily manipulated by persons familiar with the manner in which the outer cap is moved but yet sufficiently difficult to reduce the possibility that small children would be able to operate the dispensing cap to gain access to an unlimited number of pills and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
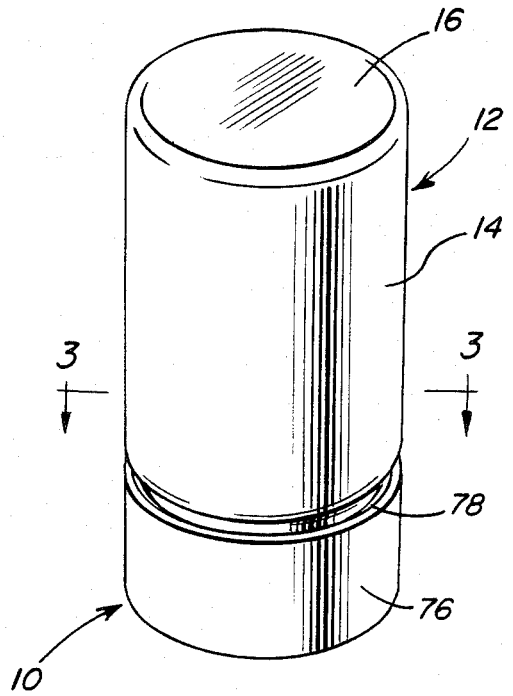
FIG. 1 is perspective view of a pill bottle or container with the dispensing cap thereon oriented in inverted position with the dispensing cap disposed below the container so that a pill or the like can be dispsensed by gravity from the container.

The dispensing cap of the present invention is generally designated by reference numeral 10 and is mounted on a conventional pill bottle, container or other container 12 which may be provided with a cylindrical wall 14, a bottom 16, a reduced neck 18 with a rib 20 at the end thereof by which the dispensing cap is attached to the container 12. The container 12 may be plastic, glass, metal and any other conventional material and may be used for pills, capsules, other medication or other items or materials. The dispensing cap may be attached to the container in other ways such as being screw threaded thereon, permanently attached thereto or otherwise affixed to the container so that a single pill can be dispensed by gravity from the container 12 when the container 12 is positioned in inverted position as illustrated in FIG. 1 with the dispensing cap 10 at the lower end thereof.

Figure 8:
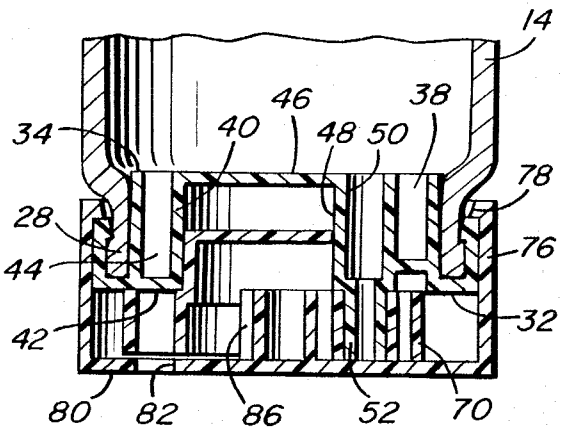
FIG. 8 is a sectional view taken substantially along a plane passing along section line 8—8 of FIG. 7 illustrating the relationship of the gear components.
Figure 6:
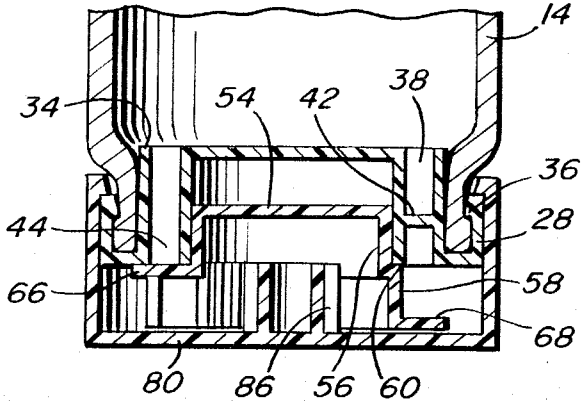
FIG. 6 is a sectional view taken substantially upon a plane passing along section line 6—6 illustrating the relationship of the components in this position.
Figure 4:
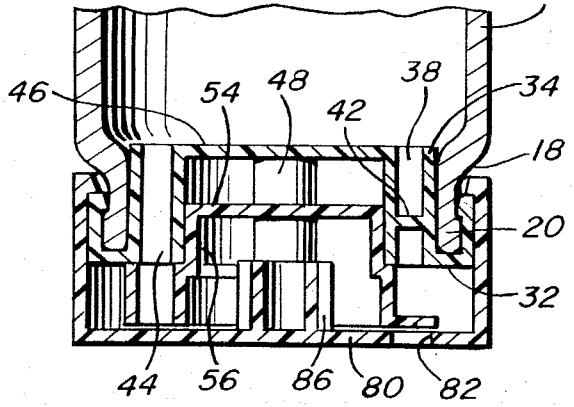
FIG. 4 is a vertical sectional view taken substantially upon a plane passing along section line 4—4 on FIG. 3 illustrating further structural details of the components with the port or chamber in the rotor being in alignment with the port in the inner cap and the port in the outer cap being diametrically opposite thereto and closed by a flange on the rotor.

The dispensing cap 10 includes an inner cap 22, an outer cap 24 and a rotor 26 which are assembled onto the container 12 in generally a telescopic arrangement as illustrated in FIGS. 4, 6 and 8 with the inner cap 22 being non-rotative in relation to the container and the outer cap 24 and the rotor 26 being rotatable in relation to the container and inner cap and in relation to each other.

The inner cap 22 includes an outer cylindrical flange 28 which telescopes over the exterior of the neck 18 of the container 12 and includes an inwardly projected rib 30 for snap fitting engagement over the external rib 20 on the neck 18 of the container. At the bottom of the cylindrical flange 28, an inwardly extending flange 32 is provided which overlies the end edge of the neck 18 of the bottle. Concentric with and spaced inwardly from the cylindrical flange 28, the inner cap 22 includes a cylindrical flange 34 which lies along side of and engages the inner surface of the neck 18 of the container. The flanges 28, 32 and 34 cooperate to define a channel 36 which telescopes over and is frictionally attached to the neck 18 of the container 12 in a well known matter. Concentrically with respect to and interiorly of the flange 34, a channel 38 is provided with the flange 34 defining the outer wall thereof and a concentric flange 40 defining the inner wall thereof. The bottom 42 of the channel 38 is inclined with its lowest point terminating in a discharge port 44 with the outer end edge of the inner flange 40 and the port being flush with the surface of the flange 32. The width of channel 38 is such that a single pill will be received therein and the inclined bottom 42 combined with the channel 38 provides an inclined raceway which will induce the pills to roll through the raceway 38 to the inner cap port 44 for discharge therefrom with the port 44 being generally rectangular in shape to enable the passage of a single pill therethrough. The shape, size and configuration of the channel and port 44 may, of course, be varied depending upon the shape and size of the pills, capsules or the like, to be dispensed. The inner end of the inner cap is provided with a generally flat wall 46 which may also be slightly crowned so that pills will move toward the channel 38. At one edge portion of the inner wall 46, a depending spindle 48 is provided which may be of solid construction or may be of tubular construction with the upper end thereof being open through the inner wall 46 as indicated by numeral 50. The spindle 48 extends outwardly beyond the flange 32 and terminates in a reduced end portion 52 as illustrated in FIG. 8 for a purpose described hereinafter.

The rotor 26 includes a generally flat top wall 54 having a downwardly extending cylindrical wall 56 engaging the inner surface of the cylindrical flange 40 over a major portion of the periphery thereof as illustrated in FIGS. 4, 6 and 8. At the lower end of the wall portion 56, there is a similar wall portion 58 which is slightly larger in diameter as compared with the wall portion 56 thus forming a shoulder 60 at the juncture therebetween. The wall portion 58 includes a radial projection 62 having the same vertical extent as the wall portion 58 with a passageway therethrough defining a port or trap chamber 64 of generally rectangular configuration and similar in shape and size as the port 44 in the inner cap 22. A radial, arcuate flange 66 is integral with the top surface of the projection 62 and flush with the shoulder 60 with the flange 66 being oriented in underlying engaging relation to the flange 32 and particularly in underlying engaging relation to the outer end of the discharge port 44 for closing the outer end of the port 44 when the flange 66 is aligned therewith as illustrated in FIG. 6 with the arcuate extent of the projection 62 and the flange 66 being generally in the order of 45° which is the scope of rotation movement of the rotor 26 in a manner described hereinafter. The outer end of the wall portion 58 is provided with an outwardly extending flange 68 which has its outer surface flush with the outer surface of the projection 62 and extends around a substantial arcuate portion of the rotor 26 in a manner described hereinafter. The rotor 26 also includes a cylindrical flange 70 having its ends in the center of the ends of flanges 66 and 68 and its inner edge forming an extension of the shoulder 60 with the flange 70 being concentric with the rotational center of the rotor 26 and provided with internal gear teeth 72 thereon for meshing engagement with an idler gear 74 rotatably journalled on the reduced end 52 of the spindle 48 with the inner end of the gear engaging the shoulder between the reduced end 52 and the remainder of the spindle 48 as illustrated in FIG. 8.

Figure 2:
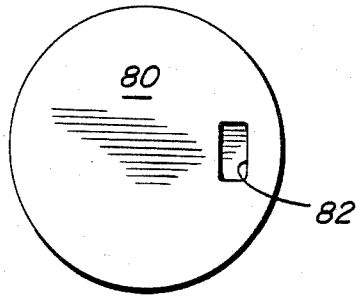
FIG. 2 is a bottom plan view of the dispensing cap illustrating the discharge port in the outer cap.
Figure 10:
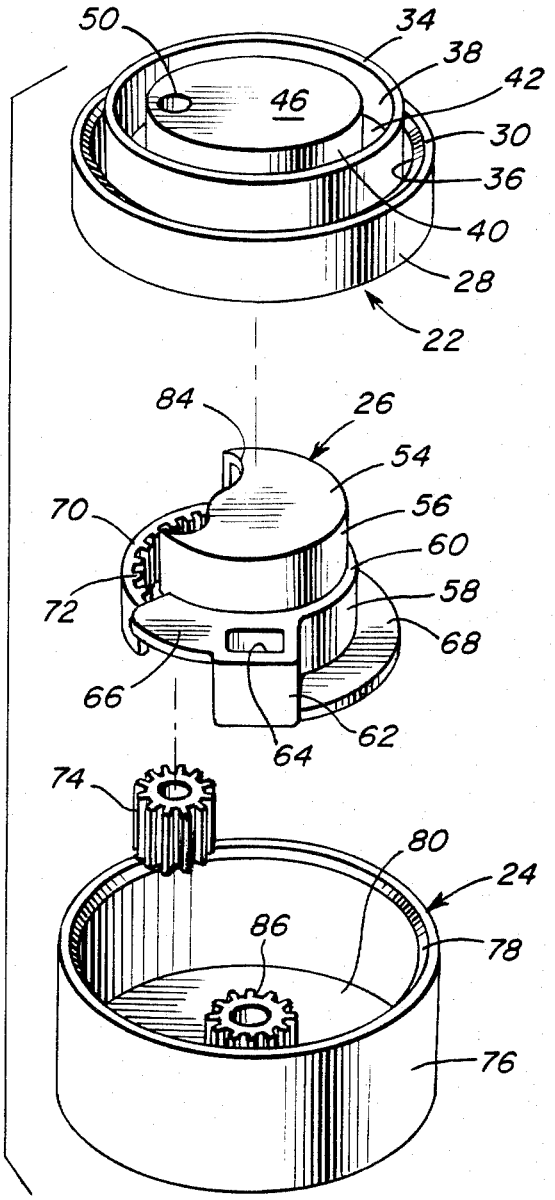
FIG. 10 is an exploded group perspective view of the components of the dispensing cap.
Figure 9:
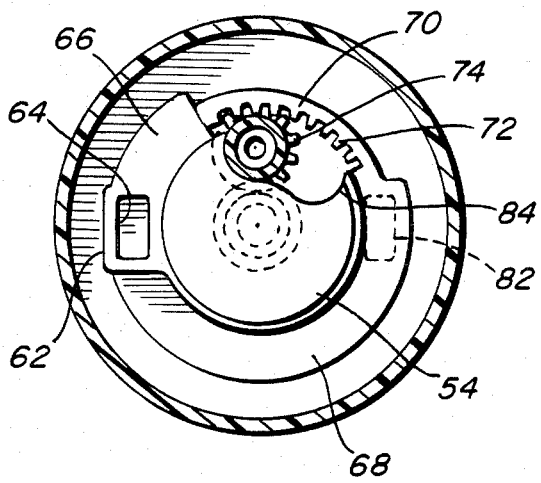
FIG. 9 is an additional sectional view illustrating the gear relationship and structural components in the position of FIG. 3.
Figure 7:
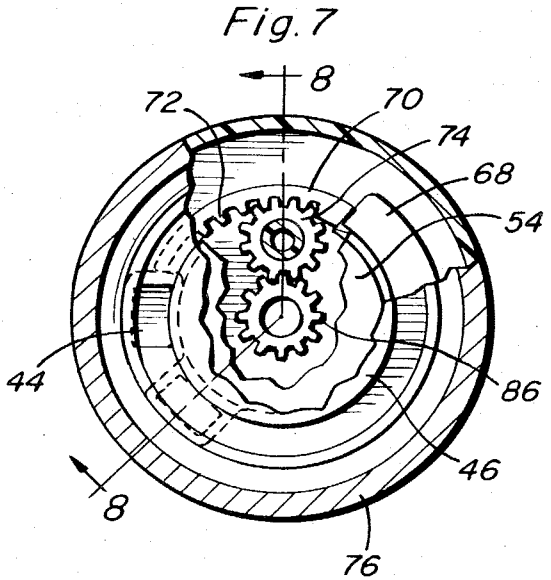
FIG. 7 is a sectional view similar to FIG. 5 but with components broken away to illustrate the geared associated between the components when the outer cap has been rotated to the relationship of FIG. 5.
Figure 5:
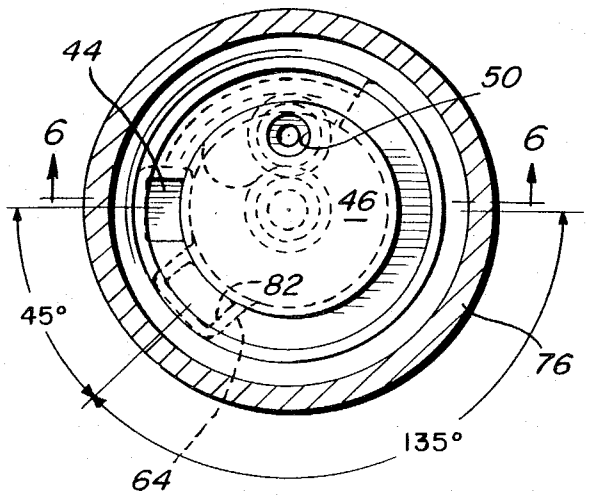
FIG. 5 is a sectional view similar to FIG. 3 but illustrating the outer cap being rotated to a position with the rotor blocking the port in the inner cap with the rotor being moved in the opposite direction to the outer cap for alignment of the rotor port or chamber with the discharge port in the outer cap.
Figure 3:
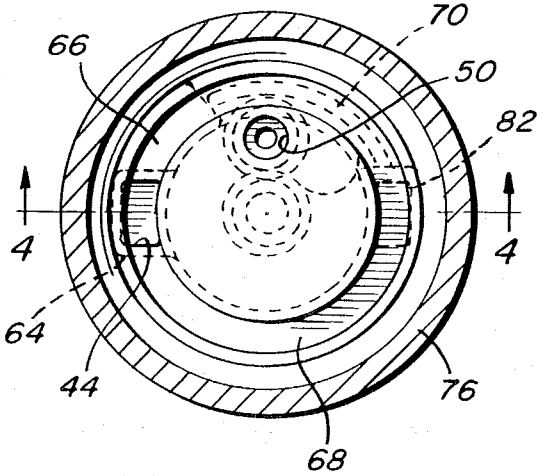
FIG. 3 is a transverse, sectional view taken substantially upon a plane passing along section line 3—3 of FIG. 1 illustrating the structural details and relationship of the components of the cap when the dispensing cap is in its closed or at rest position.

The outer cap 24 includes a cylindrical wall 76 concentric with and engaging the flange 28 on the inner cap 22 which is provided with an inturned flange 78 at its inner end for snapping engagement over the inner edge of the flange 28. The outer end of the outer cap 28 is provided with a generally flat closure wall 80 having an eccentrically arranged discharge port 82 therein of generally rectangular configuration and the same size as the ports 44 and 64. The inner surface of the wall 80 is disposed closely adjacent the outer surface of the flange 68, the projection 62, the reduced end 52 of the spindle 48 and the flange 70 when assembled so that the flange 68 will form a closure for the discharge port 82 when aligned therewith as illustrated in FIG. 4 and the inner surface of the wall 80 will form a closure for the port 64 when aligned therewith as illustrated in FIG. 4 but with the port 82 being in communication with the port 64 for discharge of a pill or other item from the port 64 through the port 82 by gravity when in aligned relation as illustrated in FIGS. 6 and 8. The top wall 54 of the rotor includes an arcuate slot or notch 84 therein which receives the spindle 48 which limits rotational movement of the rotor 26 which is rotated in a direction opposite to the outer cap 24 by a gear 86 rigid with or integral with the outer end wall 80 of the outer cap 24 which is in meshing engagement with the idler gear 74. Thus, when the gear 86 rotates in a counterclockwise direction as illustrated in FIG. 7, the gear 74 will rotate in a clockwise direction thus rotating the rotor in a counterclockwise direction or in the direction opposite to the gear 86 and thus opposite to the outer cap 24. The extent of the slot or notch 84 is such that it will permit rotational movement of the rotor of 45° and the extent of the flange 70 and internal teeth 72 thereon likewise enables 45° movement of the rotor 26. The relationship of the gears 86, 74 and the gear teeth 72 on the flange 70 is such that when the outer cap 14 is rotated 135° in a clockwise direction, the rotor will be rotated 45° in the opposite direction as illustrated in FIG. 5 so that the total relative movement of the outer cap 24 and the rotor 26 is 180° such that the discharge port 82 will move from the position illustrated in FIGS. 2 and 3 to the position illustrated in FIGS. 5–8 and at the same time, the port 64 in the rotor is moved in the opposite direction 45° so that the discharge port 82 and the port 64 become aligned with movement of the port 64 in a counterclockwise direction causing misalignment of the port 64 with the port 44 with the lower end of the port 44 then being closed by the flange 66 which has sufficient arcuate extent to maintain the lower end of port 44 closed when the port 64 moves out of alignment with the port 44 until it moves to its limit of movement so that the port 64 becomes aligned with the port 82. In the at rest or starting position illustrated in FIGS. 3, 4 and 9, the port 44 in the inner cap 22 and the port or chamber 64 in the rotor 26 are in alignment and a single pill or item to be discharged will be deposited in the chamber formed by the port 64. At this time, the port 82 is not in alignment with the port 64 and is blocked or closed by the flange 68 on the rotor as illustrated in FIG. 4. Then by rotating the outer cap 24 through an arc of 135°, the rotor 26 is driven 45° in the opposite direction thus aligning the port or chamber 64 in the rotor with the port 82 in the outer cap 24 and at the same time maintaining the port 44 in the inner cap closed by virtue of the flange 66 closely underlying the port 44 as illustrated in FIG. 6. The single pill that was in the port or chamber 64 may then be gravity discharged from the port 82 and the outer cap 24 may be rotated back to its original at rest position and the cycle of dispensing a single pill or item has been completed. The bottom of the channel 38 or raceway is inclined which induces a pill to roll along the raceway into the port 44 which is dimensioned to receive a single pill and discharge that single pill into the port or chamber 64 in the rotor. The width of the channel 38 is constructed to be one pill wide to prevent bridging of pills to assure that pills will be properly oriented for sequential positioning in the discharge port 44 during the dispensing cycles. The external spur gear on the outer cap and the idler gear as well as the segmental gear may all be constructed of plastic as are the other components thereby rendering the device relatively inexpensive to manufacture and easy to snap onto existing containers or be placed on containers when they are distributed to the users with the construction being relatively inexpensive to enable the dispensing cap to be economically used with various types of containers.

By using this device, children will not have ready access to a large number of pills since it is unlikely that they would discover that pills could be repetitively dispensed by repeating the cycles of operation of the dispensing cap and smaller children would not recognize how to gain access even to a single pill. With proper instructional indicia placed on the cap or container, persons having ordinary skill levels and finger dexterity will be able to rapidly and effectively operate the dispensing cap to enable quick access to pills when desired. Also, the dispensing cap maintains the container closed and by providing proper tolerance between the components, the pills or material in the container may be substantially sealed and maintained in a clean and sanitary condition.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A dispensing cap for a container to enable a single item to be dispensed from the container, said dispensing cap comprising an inner cap adapted to be non-rotatably connected to the container, an outer cap rotatably associated with the inner cap and container, a rotor positioned between the inner cap and outer cap and rotatable in relation to each of the caps and the container, said inner cap including a discharge port, said outer cap including a discharge port, said rotor including a chamber movable between positions in alignment with and misalignment with the ports in the inner and outer caps with the chamber in the rotor being of a size to receive only a single item to be discharged, and means interconnecting the inner cap, rotor and outer cap to rotate the rotor in response to rotational movement of the outer cap with the rotating movement of the rotor being at a different speed than the rotating movement of the outer cap for moving the rotor from a position with its chamber in alignment with the port in the inner cap to a position in alignment with the port in the outer cap upon rotational movement of the outer cap through a predetermined arc.

2. The dispensing cap of claim 1 wherein said rotor includes a flange associated with the discharge port in the outer cap when the discharge port in the outer cap and the chamber in the rotor are misaligned to retain the discharge port in the outer cap in closed condition.

3. The dispensing cap as defined in claim 2 wherein said rotor includes a flange alignable with the discharge port in the inner cap when the chamber in the rotor is moved away from its aligned position with the port in the inner cap thereby forming a closure for the port in the inner cap to prevent items from falling by gravity from the discharge port in the inner cap when the chamber in the rotor is misaligned therewith.

4. The dispensing cap as defined in claim 3 wherein said inner cap includes an inclined raceway formed by spaced concentric walls and an inclined bottom communicating with the discharge port in the inner cap at its lowest point to induce items having a cylindrical surface to roll toward the discharge port with the space between the walls defining the raceway being spaced apart a distance to receive items in single file.

5. The dispensing cap of claim 4 wherein said means interconnecting the inner cap, rotor and outer cap includes an internal segmental gear on the rotor, an external spur gear centrally mounted on the outer cap and an idler gear journalled on the inner cap and in meshing engagement with the spur gear on the outer cap and the segmental gear on the rotor to move the rotor in a direction opposite to rotational movement of the outer cap.

6. The dispensing cap of claim 5 wherein said gears are associated in a manner that rotational movement of the outer cap through an arc of 135° in one direction will cause rotational movement of the rotor in the opposite direction through an arc of 45° with the chamber in the rotor and the port in the outer cap becoming aligned when the outer cap and rotor are moved through their predetermined arcs.

7. The dispensing cap of claim 6 wherein said idler gear is mounted on a spindle extending through the rotor, said rotor including an arcuate slot receiving the spindle with the slot having an arcuate extent enabling rotation of the rotor through an arc of 45° thereby limiting rotational movement of the rotor and outer cap with the chamber in the rotor moving from a position in alignment with the port in the inner cap in one direction into registry with the port in the outer cap which has moved in the opposite direction through a larger arc than the arc of movement of the chamber in the rotor.

8. In combination with a pill bottle having an open mouth, a dispensing cap mounted securely on the pill bottle for dispensing one pill for each cycle of operation of the dispensing cap by gravity when the container and dispensing cap are oriented with the dispensing cap positioned downwardly in relation to the bottle, said dispensing cap including an inner cap engaged with the mouth of the bottle for mounting the dispensing cap on the bottle with the inner cap being non-rotative in relation to the bottle, a rotor rotatably mounted on the inner cap and engaged with the outer surface thereof, an outer cap enclosing the rotor and rotatably secured to the inner cap for rotational movement in relation thereto during each dispensing cycle, of the inner cap and outer cap including a port and the rotor including a chamber for selective alignment and misalignment in relation to each other and means interconnecting the inner cap, rotor and outer cap to rotate the rotor in relation to the inner cap and in relation to the outer cap when the outer cap is rotated during a dispensing cycle to move the chamber in the rotor from a position aligned with the port in the inner cap to a new position displaced arcuately therefrom and to enable the port in the outer cap to move from an original position out of alignment with the chamber on the rotor to a new position arcuately spaced therefrom in alignment with the chamber in the rotor when in its new position.

9. The combination as defined in claim 8 wherein said means interconnecting the inner cap, rotor and outer cap includes gear means moving the rotor in opposite rotational direction to the rotational direction of rotation of the outer cap when the port is moved from its original to its new position.

10. The combination as defined in claim 9 wherein said gear means includes meshing gears interconnecting the outer cap, rotor and inner cap to move the rotor through an arc of 45° when the outer cap is rotated through an arc of 135°.

11. The combination as defined in claim 10 wherein said chamber on the rotor is vertically elongated to form a trap chamber of a size to closely receive one pill, said rotor including flanges thereon with one flange forming a closure for the port on the inner cap when the chamber on the rotor moves out of alignment with the port on the inner cap, another flange on the rotor being in alignment with and forming a closure for the port in the outer cap until the outer cap and rotor are rotated in relation to each other to align the port in the outer cap with the chamber in the rotor.

12. The combination as defined in claim 11 wherein said inner cap includes a channel having an inclined bottom extending peripherally thereof interiorly of the bottle for receiving pills in single file so that the pills will be guided singly into the port in the inner cap.

* * * * *